US006979959B2

(12) United States Patent
Henry

(10) Patent No.: US 6,979,959 B2
(45) Date of Patent: Dec. 27, 2005

(54) APPARATUS AND METHOD FOR STRIKING A FLUORESCENT LAMP

(75) Inventor: George C. Henry, Simi Valley, CA (US)

(73) Assignee: Microsemi Corporation, Irvine, CA (US)

( * ) Notice: Subject to any disclaimer, the term of this patent is extended or adjusted under 35 U.S.C. 154(b) by 10 days.

(21) Appl. No.: 10/453,760

(22) Filed: Jun. 3, 2003

(65) Prior Publication Data

US 2004/0113569 A1 Jun. 17, 2004

Related U.S. Application Data

(60) Provisional application No. 60/433,557, filed on Dec. 13, 2002.

(51) Int. Cl.[7] ..... G05F 1/00

(52) U.S. Cl. ..... 315/291; 315/307; 315/224; 315/276

(58) Field of Search ..... 315/291, 307, 315/213, 224, 279, 276, 308, 360, DIG. 5

(56) References Cited

U.S. PATENT DOCUMENTS

| | | | | | |
|---|---|---|---|---|---|
| 4,700,113 | A | | 10/1987 | Stupp et al. | 315/224 |
| 4,717,863 | A | | 1/1988 | Zeiler | 315/307 |
| 5,049,790 | A | | 9/1991 | Herfurth et al. | 315/291 |
| 5,235,254 | A | | 8/1993 | Ho | 315/219 |
| 5,615,093 | A | * | 3/1997 | Nalbant | 363/25 |
| 5,923,129 | A | | 7/1999 | Henry | 315/307 |
| 5,930,121 | A | * | 7/1999 | Henry | 363/16 |
| 6,160,362 | A | | 12/2000 | Shone et al. | 315/308 |
| 6,172,468 | B1 | | 1/2001 | Holländer | 315/291 |
| 6,188,183 | B1 | | 2/2001 | Greenwood et al. | 315/307 |
| 6,198,234 | B1 | * | 3/2001 | Henry | 315/291 |
| 6,259,615 | B1 | * | 7/2001 | Lin | 363/98 |
| 6,316,887 | B1 | * | 11/2001 | Ribarich et al. | 315/307 |
| 6,359,393 | B1 | * | 3/2002 | Brown | 315/307 |

* cited by examiner

*Primary Examiner*—Tuyet Thi Vo
(74) *Attorney, Agent, or Firm*—Knobbe Martens Olson & Bear, LLP

(57) ABSTRACT

A lamp inverter with continuous strike voltage facilitates faster striking of a fluorescent lamp, especially at cold temperatures. A frequency sweep generator sweeps the frequency of the lamp inverter to a striking frequency corresponding to a striking lamp voltage and then maintains the striking frequency until the lamp strikes.

36 Claims, 5 Drawing Sheets

APPARATUS AND METHOD FOR STRIKING A FLUORESCENT LAMP

CLAIM FOR PRIORITY

This application claims the benefit of priority under 35 U.S.C. § 119(e) of U.S. Provisional Application No. 60/433,557 entitled "Apparatus and Method for Striking a Fluorescent Lamp," filed on Dec. 13, 2002, the entirety of which is incorporated herein by reference.

BACKGROUND OF THE INVENTION

1. Field of the Invention

The present invention relates to a power conversion circuit for driving fluorescent lamps, such as, for example, cold cathode fluorescent lamps (CCFLs), and more particularly relates to starting a fluorescent lamp with improved efficiency.

2. Description of the Related Art

Fluorescent lamps are used in a number of applications where light is required but the power required to generate the light is limited. One particular type of fluorescent lamp is a cold cathode fluorescent lamp (CCFL). CCFLs are used for back lighting or edge lighting of liquid crystal displays (LCDs), which are typically used in notebook computers, web browsers, automotive and industrial instrumentations, and entertainment systems. Such fluorescent lamps require a high starting voltage (on the order of 700–1,600 volts) for a short period of time to ionize the gas contained within the lamp tubes for ignition. After the gas in the CCFL is ionized and the CCFL is fired, less voltage is needed to keep the CCFL on.

A CCFL tube typically contains a gas, such as Argon, Xenon, or the like, along with a small amount of Mercury. After an initial ignition stage and the formation of plasma, current flows through the tube, which results in the generation of ultraviolet light. The ultraviolet light in turn strikes a phosphorescent material coated in the inner wall of the tube, resulting in visible light.

A power conversion circuit is generally used for driving the CCFL. The power conversion circuit accepts a direct current (DC) input voltage and provides an alternating current (AC) output voltage to the CCFL. The brightness (or the light intensity) of the CCFL is controlled by controlling the current (i.e., the lamp current) through the CCFL. For example, the lamp current can be amplitude modulated or pulse width modulated to control the brightness of the CCFL.

One type of power conversion circuits includes a resonant circuit. The power conversion circuit includes switching transistors in a half bridge topology or a full bridge topology using power metal-oxide-semiconductor-field-effect-transistors (MOSFETs) to provide the DC to AC conversion. Maximum power is provided at the output of the power conversion circuit by switching the MOSFETs with driving signals at a resonant frequency. To control the output voltage as well as the current through the lamp, the power conversion circuit can change the frequency of the driving signals either towards the resonant frequency or away from the resonant frequency.

SUMMARY OF THE INVENTION

One aspect of the present invention is a power conversion circuit (or a lamp inverter) with a strike circuit to apply a continuous strike voltage at an output to a fluorescent lamp for efficient ignition of the fluorescent lamp. The strike circuit helps the fluorescent lamp to start (or to strike) in a relatively short time, especially at relatively cold temperatures. The strike circuit maintains the continuous strike voltage at a relatively high level when the power conversion circuit is in an ignition mode (or a striking mode). After the fluorescent lamp strikes, the power conversion circuit enters a normal operating mode and a relatively lower level normal operating voltage is provided at the output to the fluorescent lamp.

The power conversion circuit can employ half-bridge, full-bridge or direct drive inverter topologies. In one embodiment, the power conversion circuit includes a pulse width modulation (PWM) controller, a primary network, a secondary network, a current feedback circuit, a voltage feedback circuit and a strike circuit. The PWM controller provides driving signals to the primary network to produce a substantially AC output voltage at the secondary network. The secondary network is coupled to the fluorescent lamp. The voltage feedback circuit is coupled to the secondary network to monitor the voltage provided to the fluorescent lamp, and the current feedback circuit is coupled to the fluorescent lamp to monitor the current flowing through the fluorescent lamp. The respective outputs of the voltage feedback circuit and the current feedback circuit are provided to the strike circuit. The strike circuit controls the frequency of the driving signals provided to the primary network.

In one embodiment, the power conversion circuit includes a direct drive inverter that generates a substantially AC output signal to drive the fluorescent lamp. The direct drive inverter includes a direct drive controller, a direct drive network and a secondary network. The direct drive controller provides driving signals to the direct drive network to produce a substantially AC output voltage at the secondary network. The secondary network is coupled to the fluorescent lamp, such as a CCFL, and the substantially AC output voltage results in a substantially AC current (i.e., a lamp current) which flows through the CCFL to illuminate the CCFL. Initially, the substantially AC output voltage is maintained at a relatively constant high level to ignite (or to start the lamp current flowing through) the CCFL. After the CCFL ignites, the level of the substantially AC output voltage is lower to maintain a flow of lamp current through the CCFL.

In one embodiment, the level of the substantially AC output voltage is controlled by varying the frequency of the driving signals. In one embodiment, power conversion circuit sweeps the frequency of the driving signals from an initial frequency to a striking frequency (e.g., one to five times the normal operating frequency) during an ignition process. For example, in one embodiment, the power conversion circuit sweeps the frequency of the driving signals from a relatively low normal operating frequency to a relatively high striking frequency (e.g., one to five times the normal operating frequency) during an ignition process. Inductance of the secondary network and capacitance of the CCFL form a resonant circuit. The capacitance of the CCFL changes from a relatively low value when the CCFL is not lighted to a higher value after ignition. Thus, the resonant circuit has a relatively high unloaded resonant frequency (i.e., a relatively high resonant frequency when the CCFL is not ignited). The rising frequency of the driving signals causes the level of the substantially AC output voltage to rise as the frequency of the driving signals approaches the unloaded resonant frequency. Alternatively, in one embodiment, the power conversion circuit sweeps the frequency of the driving signals down from an initial frequency that is higher than the striking frequency to the relatively high striking frequency during an ignition process.

In one embodiment, the strike circuit (or a frequency sweep generator circuit) manages the frequency (or timing) of the driving signals in the ignition mode. The strike circuit monitors the status of the CCFL and the substantially AC output voltage to control the frequency of the driving signals. For example, the strike circuit checks for ignition of the CCFL as part of a start-up sequence. If the CCFL is not ignited, the strike circuit can sweep the frequency of the driving signals up or down from an initial frequency to a relatively high striking frequency. The relatively high striking frequency corresponds to the power conversion circuit producing a substantially AC output voltage (i.e., a striking voltage) with a level sufficient to start an unlighted CCFL. After the lamp strikes, the strike circuit shifts the frequency to a normal operating frequency that is relatively lower than the striking frequency.

If the strike circuit detects ignition of the CCFL during the frequency sweep, the strike circuit stops the frequency sweep and resets the frequency of the driving signals to the normal operating frequency for normal operations. If the striking frequency is reached before the CCFL ignites during the frequency sweep, the strike circuit locks (or stops sweeping) the frequency of the driving signals. The frequency of the driving signals stays at the striking frequency to continuously apply the striking voltage to the unlighted CCFL. The strike circuit continues to monitor the status of the CCFL and reduces the frequency of the driving signals to the normal operating frequency once the CCFL ignites. The continuous application of the striking voltage advantageously facilitates faster starting of the CCFL.

In one embodiment, the strike circuit outputs a fault signal if the strike circuit fails to detect ignition of the CCFL after a predetermined duration of applying the striking voltage to the CCFL. The fault signal can indicate a faulty or missing CCFL. The fault signal can be provided to the direct drive controller to effectively shut down the power conversion circuit. In one embodiment, the strike circuit can be integrated with the direct drive controller.

In one embodiment, the strike circuit monitors the status of the CCFL by monitoring the lamp current. For example, the absence of lamp current indicates that the CCFL is not ignited. The presence of lamp current with a predefined minimum amplitude and for a predefined minimum duration indicates reliable ignition of the CCFL. The strike circuit can monitor the level of the substantially AC output voltage using a capacitive divider placed across (or in parallel) with the CCFL. The capacitive divider produces a scaled version of the relatively high voltage levels of the substantially AC output voltage for efficient processing by the strike circuit.

DETAILED DESCRIPTION

Figure 1:
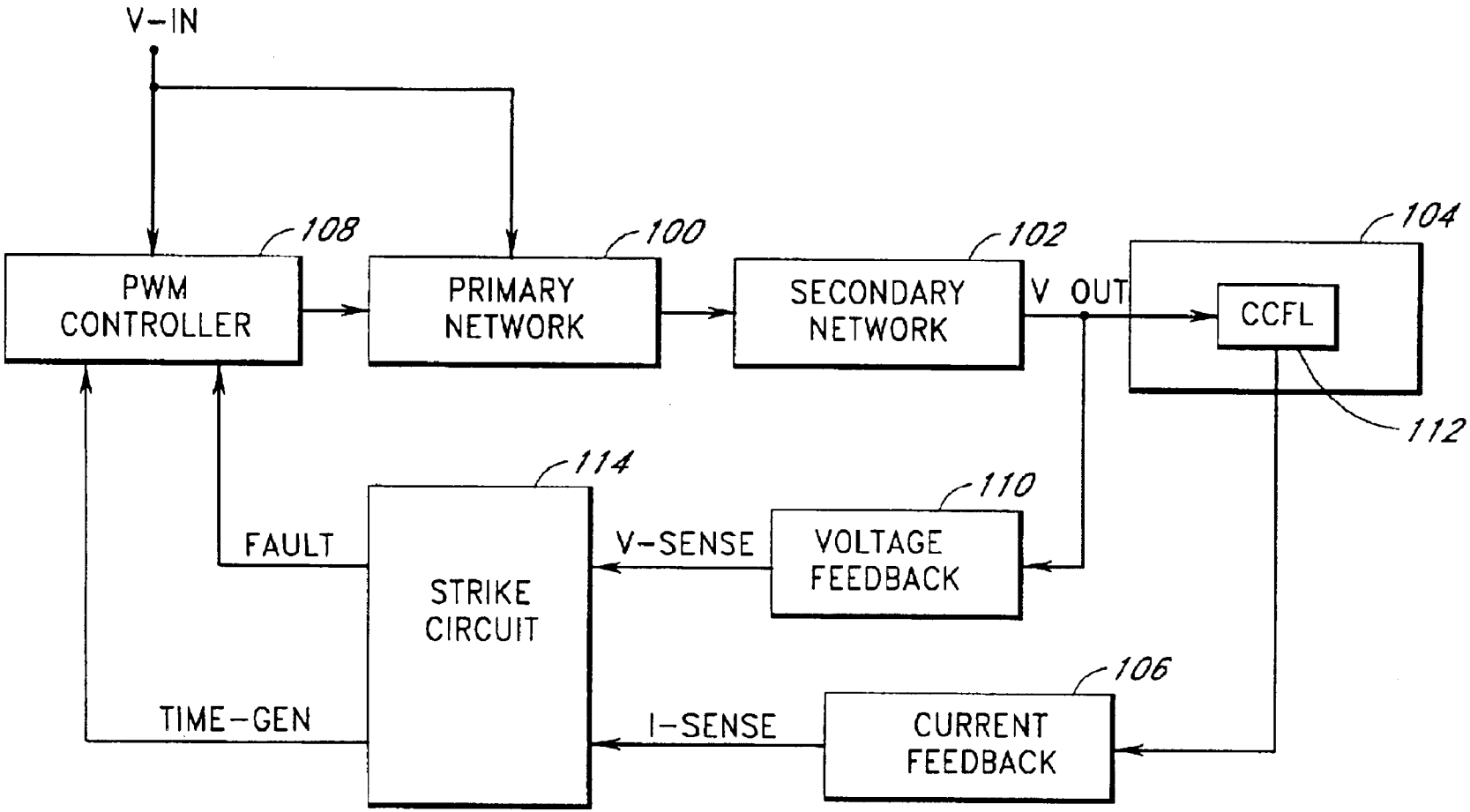
FIG. 1 is a block diagram of a power conversion circuit according to one embodiment of the present invention.

Embodiments of the present invention will be described hereinafter with reference to the drawings. FIG. 1 is a block diagram of a power conversion circuit according to one embodiment of the present invention. The power conversion circuit (or the lamp inverter) converts a substantially DC input voltage (V-IN) into a substantially AC output voltage (V-OUT) to drive a CCFL 112. An AC current (or a lamp current) flows through the CCFL 112 to provide illumination in an electronic device 104, such as, for example, a flat panel display, a personal digital assistant, a palm top computer, a scanner, a facsimile machine, a copier, or the like.

The power conversion circuit includes a PWM controller 108, a primary network 100, a secondary network 102, a current feedback circuit 106, a voltage feedback circuit 110 and a strike circuit 114. The input voltage (or the supply voltage) is provided to the primary network 100 and the PWM controller 108. The primary network 100 is controlled by driving signals provided by the PWM controller 108. The secondary network 102 is coupled to the primary network 100 and produces the output voltage to drive the CCFL 112. The current feedback circuit 106 is coupled to the CCFL 112 and generates a current feedback signal (I-SENSE) indicative of the lamp current level for the strike circuit 114. The voltage feedback circuit 110 is coupled to the output of the secondary network 102 and generates a voltage feedback signal (V-SENSE) indicative of the output voltage level for the strike circuit 114. The strike circuit 114 provides a fault output (FAULT) and a timing output (TIME-GEN) to the PWM controller 108.

The strike circuit (or the frequency sweep generator) 114 improves ignition time of the CCFL 112 and reliability of the power conversion circuit. The CCFL 112 typically requires a relatively high voltage to ignite and can operate at a relatively lower voltage after ignition. The output of the power conversion circuit and the CCFL 112 form a resonant circuit. The amplitude of the output voltage can be controlled by changing the frequency of the output voltage either towards the resonant frequency or away from the resonant frequency. The frequency of the output voltage follows the frequency of the driving signals provided by the PWM controller 108 to the primary network 100. Thus, the amplitude of the output voltage to drive the CCFL 112 can be varied by varying the frequency of the driving signals.

In one embodiment of an ignition process, the strike circuit 114 provides the timing output to the PWM controller 108 to sweep the frequency of the driving signals from an initial frequency to a striking frequency corresponding to a predetermined output voltage (or a striking voltage) sufficient to ignite an unlighted CCFL. In one embodiment, the initial frequency is lower than the striking frequency. In one embodiment, the initial frequency is higher than the striking frequency. In one embodiment, the initial frequency corresponds to the normal operating frequency. The strike circuit 114 stops sweeping and stays at the striking frequency to continuously apply the striking voltage to an unlighted CCFL until the CCFL ignites.

For example, the strike circuit 114 can monitor the status of the CCFL 112 using the current feedback signal (or the sensed current). If the CCFL 112 is unlighted (e.g., the sensed current is below a predefined threshold), the strike circuit 114 begins sweeping the frequency of the driving signals from a relatively low normal operating frequency to an increasingly higher frequency while monitoring the voltage feedback signal (or the sensed voltage). When the sensed voltage reaches a predefined level corresponding to the striking voltage, the strike circuit 114 stops sweeping and locks the frequency of the driving signals to continuously apply the striking voltage to the unlighted CCFL 112. Continuous application of the striking voltage to the CCFL 112 facilitates faster striking of the CCFL 112, especially at cold temperatures.

The strike circuit 114 continuously monitors the status of the CCFL 112 and terminates the ignition process once the CCFL 112 strikes. For example, the strike circuit 114 resets the frequency of the driving signals to the normal operating frequency once the sensed current is above the predefined threshold for a sufficient period of time indicating that the CCFL 112 has reliably started.

In one embodiment, if the CCFL 112 does not start after a predetermined period of time (or a time-out period) during continuous application of the striking voltage to the CCFL 112, the strike circuit 114 provides the fault output to the PWM controller 108 to shut down the power conversion circuit. The fault output may indicate that the CCFL 112 is defective or missing. Shutting down the power conversion circuit avoids overheating the power conversion circuit resulting from prolong high frequency operation.

The timing output provided by the strike circuit 114 can be a control signal to control a frequency generator in the PWM controller 108. Alternatively, the timing output can be a ramp signal provided to a PWM circuit in the PWM controller 108. The strike circuit 114 varies the frequency of the ramp signal to vary the frequency of the driving signals outputted by the PWM controller 108.

Figure 2:
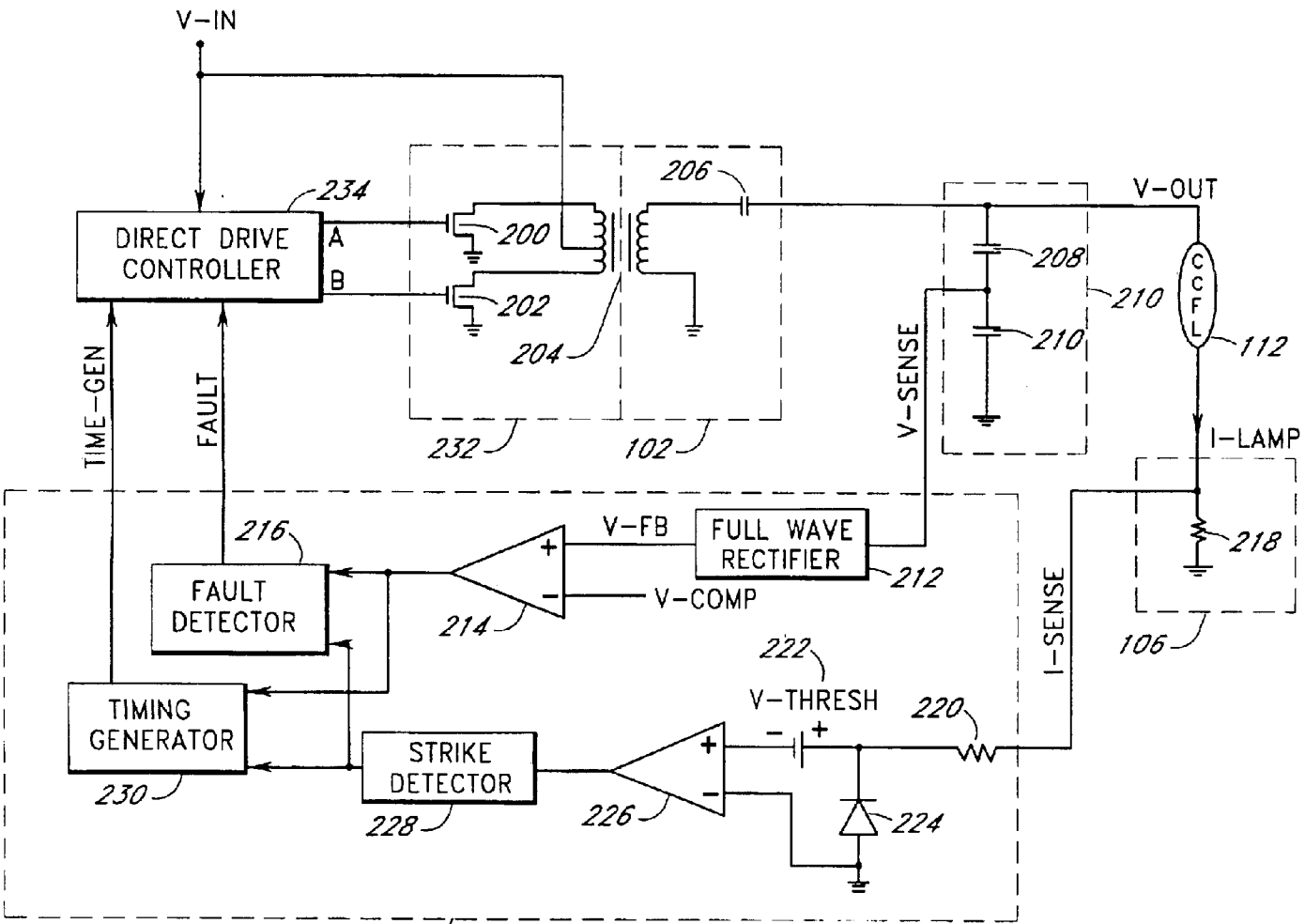
FIG. 2 is a circuit diagram of one embodiment of the power conversion circuit shown in FIG. 1.

FIG. 2 a circuit diagram of one embodiment of the power conversion circuit shown in FIG. 1. The primary network 100 is a direct drive network 232, and the PWM controller 108 is a direct drive controller 234. The direct drive network 232 is controlled by two driving signals (A and B) provided by the direct drive controller 234 and works with the secondary network 102 to provide the output voltage (V-OUT) to the CCFL 112. The current feedback circuit 106 is coupled in series with the CCFL 112 to provide the sensed current (I-SENSE) indicative of the lamp current (I-LAMP) to the strike circuit 114. The voltage feedback circuit 110 is coupled in parallel with the CCFL 112 to provide the sensed voltage (V-SENSE) indicative of the output voltage to the strike circuit 114.

In one embodiment, the direct drive network 232 includes switching transistors 200, 202 and a primary winding of a transformer 204. In one configuration, the input voltage is provided to a center-tap of the primary winding of the transformer 204. The switching transistors 200, 202 are coupled to respective opposite terminals of the primary winding of the transformer 204 to alternately switch the respective terminals to ground. For example, the first switching transistor 200 is a n-type field-effect-transistor (N-FET) with a drain terminal coupled to a first terminal of the primary winding of the transformer 204 and a source terminal coupled to ground. The second switching transistor 202 is a N-FET with a drain terminal coupled to a second terminal of the primary winding of the transformer 204 and a source terminal coupled to ground. The switching transistors 200, 202 are controlled by the respective driving signals (A, B) which are coupled to gate terminals of the respective switching transistors 200, 202.

An AC signal (or a transformer drive signal) on the primary winding results from alternating conduction by the switching transistors 200, 202 which is controlled by the direct drive controller 234. Other configurations (e.g., half-bridge or full-bridge inverter topologies) to couple the input voltage and switching transistors to the transformer are possible to produce the transformer drive signal. The AC signal is magnetically coupled to a secondary winding of the transformer 204 in the secondary network 102, which also includes a DC blocking capacitor 206. A first terminal of the secondary winding of the transformer 204 is coupled to ground while a second terminal of the secondary winding is coupled to a first terminal of the capacitor 206. The second terminal of the capacitor 206 is coupled to a first terminal of the CCFL 112.

In one embodiment, the voltage feedback circuit 110 is a capacitor divider coupled between the first terminal of the CCFL 112 and ground. For example, a first capacitor 208 is coupled between the first terminal of the CCFL 112 and a first node. A second capacitor 210 is coupled between the first node and ground. The voltage across the second capacitor 210 is proportional to the output voltage and is provided as the sensed voltage (V-SENSE) to the strike circuit 114 to indicate the output voltage level.

A second terminal of the CCFL 112 is coupled to the current feedback circuit 106. In one embodiment, the feedback circuit 106 includes a sensing resistor 218 coupled between the second terminal of the CCFL 112 and ground. The lamp current substantially flows through the sensing resistor 218, and the voltage across the sensing resistor 218 is provided as the sensed current (I-SENSE) to the strike circuit 114 to indicate the lamp current level.

Alternately, the current feedback circuit 106 can be coupled to the secondary network 102 to generate a current feedback signal indicative of the operating conditions of the CCFL 112. For example, the sensing resistor 218 can be inserted between the first terminal of the secondary winding and ground to generate a feedback signal indicative of the lamp current level.

The output voltage (or the lamp voltage) to start an unlighted CCFL (i.e., the striking lamp voltage) needs to be higher than the lamp voltage to keep a lighted CCFL running (i.e., the running lamp voltage). One method of providing the higher striking lamp voltage is to increase the frequency of the transformer drive signal (or the driving signals) from a low running frequency to a higher striking frequency during ignition of the CCFL 112.

Because the drive circuitry connected to the primary winding of the transformer 204 consists solely of the two switching transistors 200, 202 and does not include any resonant components, the primary winding can be readily driven at a wide range of frequencies. The transformer 204 and the CCFL 112 form a resonant circuit which has a higher resonant frequency when the CCFL 112 is not ignited. By increasing the frequency of the transformer drive signal closer to the higher resonant frequency, the corresponding lamp voltage increases towards a striking potential.

One embodiment of the present invention uses the strike circuit 114 to sweep the frequency of the transformer drive signal to a striking frequency corresponding to the striking lamp voltage and then maintains the striking frequency to continuously provide the striking lamp voltage until the CCFL 112 strikes. Continuous application of the striking lamp voltage facilitates faster striking of the CCFL 112, especially at cold temperatures.

In one embodiment, the strike circuit 114 includes a full-wave rectifier 212, a first comparator 214, a current limiting resistor 220, a clamping diode 224, a voltage reference 222, a second comparator 226, a strike detector circuit 228, a fault detector circuit 216 and a timing generator circuit 230. The fault detector circuit 216 outputs a fault signal (FAULT) to the direct drive controller 234 to shut down the power conversion circuit when fault conditions are present. The timing generator circuit 230 outputs a timing signal (TIME-GEN) to the direct drive controller 234 to control the frequency of the driving signals.

The strike circuit 114 monitors the output voltage (or the lamp voltage) and the lamp current to control striking of the CCFL 112. The output voltage is monitored to determine when the output voltage level reaches a striking potential. For example, the sensed voltage indicative of the output voltage is provided to the full-wave rectifier 212. The full-wave rectifier 212 outputs a feedback voltage (V-FB) which indicates the level of the output voltage to the first comparator 214. In addition to the output from the full-wave rectifier 212, the first comparator 214 receives a comparison voltage (V-COMP). The first comparator 214 outputs a first signal when the sensed voltage is greater than the comparison voltage indicating that the output voltage has reached a striking potential. The first signal is provided to both the fault detector circuit 216 and the timing generator circuit 230.

The lamp current is monitored to determine when the CCFL 112 ignites. For example, the sensed current indicative of the lamp current is provided to a first terminal of the current limiting resistor 220. The value of the current limiting resistor 220 is relatively large (e.g., 200 kilo-Ohms) to ensure accurate readings of the lamp current. The clamping diode 224 is coupled between the second terminal of the current limiting resistor 220 and ground to limit the levels of the negative lamp current cycles to the diode threshold. The reference voltage is coupled between the second terminal of the current limiting resistor 220 and a positive input terminal of the second comparator 226. A negative input terminal of the second comparator 226 is coupled to ground.

The second comparator 226 outputs a pulse when the level of a lamp current cycle exceeds the reference voltage. The output of the second comparator 226 is provided to the strike detector circuit 228. In one embodiment, the strike detector circuit 228 counts the pulses and outputs a second signal indicating that the CCFL 112 is lighted when the number of consecutive pulses exceed a predetermined number. The second signal is provided to both the fault detector circuit 216 and the timing generator circuit 230.

The timing generator circuit 230 generates the timing signal to control the frequency of the driving signals based on the first signal indicating when the output voltage reaches the striking potential and the second signal indicating when the CCFL 112 ignites. For example, when the second signal indicates that the CCFL 112 has not ignited during a striking process, the timing generator 230 causes the frequency of the driving signals to increase gradually (or to sweep from a relatively low frequency to higher frequencies) via the timing signal to the direct drive controller 234 until the first signal indicates that the output voltage has reached a striking potential. When the output voltage reaches the striking potential and the CCFL 112 is still unlighted, the timing generator circuit 230 stops sweeping and holds the frequency of the driving signals to continuously apply the striking potential to the CCFL 112 until the second signal indicates that the CCFL 112 has ignited. Once the CCFL 112 ignites, the striking process ends and the timing generator 230 resets the frequency of the driving signals to the normal operating frequency.

In one embodiment, the timing signal controls the frequency of an oscillator in the direct drive controller 234. In an alternate embodiment, the timing generator 230 includes an oscillator, and the timing signal is a ramp signal provided to a PWM circuit in the direct drive controller 234. The frequency of the ramp signal determines the frequency of the driving signals provided to the direct drive network 232. The circuits in the strike circuit 114 can be integrated with the direct drive controller 234.

The fault detector circuit 216 generates the fault signal to override other control signals and to shut down the power conversion circuit when fault conditions occur during the striking process. For example, when the CCFL 112 fails to strike after a predetermined period (a time-out period) of applying the striking potential to the CCFL 112, the fault detector circuit outputs the fault signal to the direct drive controller 234 to shut down the power conversion circuit. In one embodiment, the fault detector circuit 216 starts a timer when the first signal from the first comparator 214 indicates the output voltage has reached a striking potential. The timer expires after a predetermined time. If the second signal from the strike detector circuit 228 did not indicate the CCFL 112 has ignited before the timer expires, the fault detector circuit 216 outputs the fault signal. The fault signal may indicate that the CCFL 112 is missing or defective.

Figure 3:
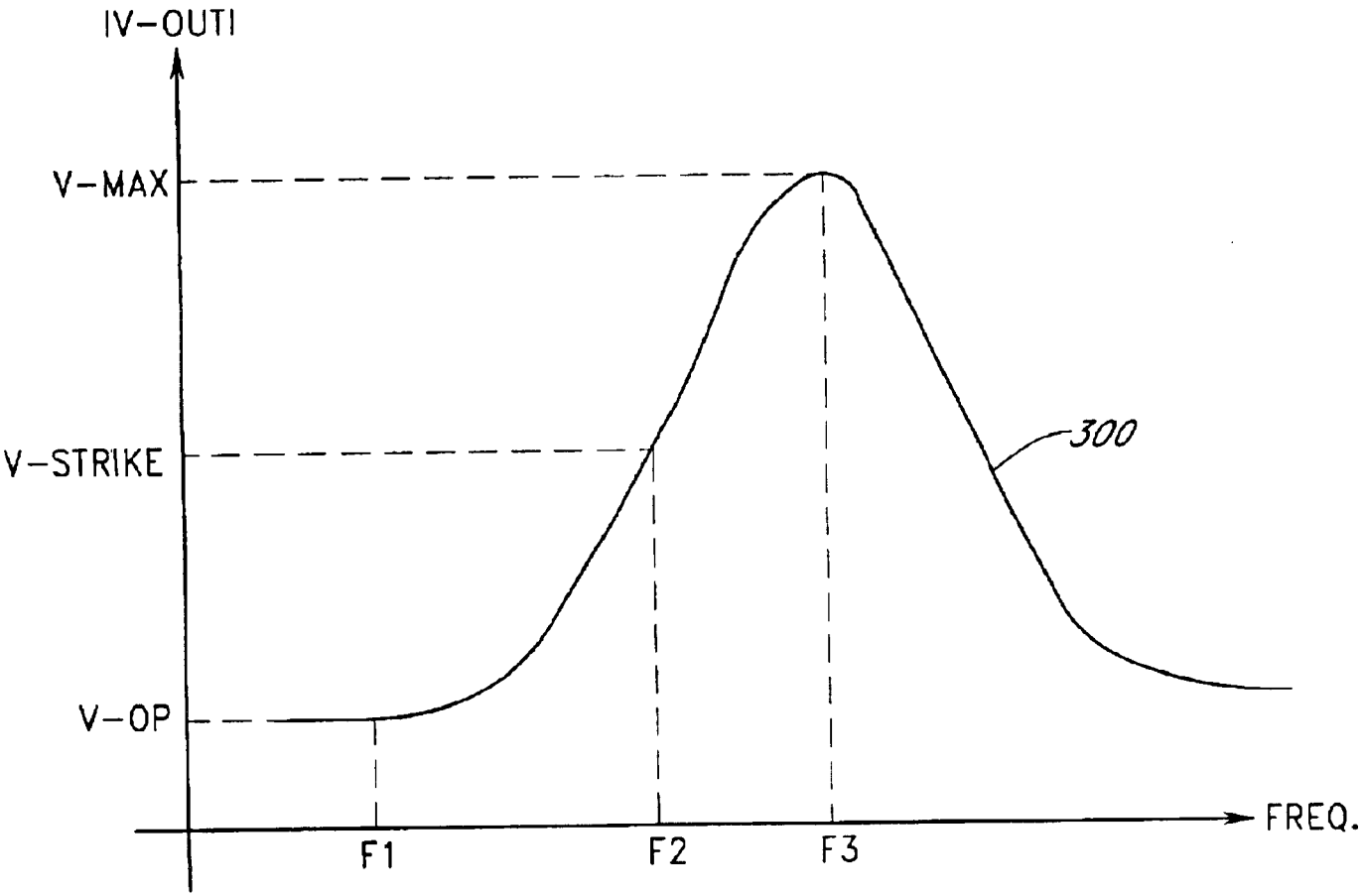
FIG. 3 illustrates output voltage amplitudes of the power conversion circuit as a function of frequency.

FIG. 3 illustrates output voltage amplitudes of the power conversion circuit as a function of frequency. A graph 300 shows the amplitude of the output voltage is relatively low at low frequencies, gradually increases with increasing frequency, reaches a peak (or maximum) at a resonant frequency (F3), and thereafter decreases with increasing frequency. The normal operating frequency (or the run frequency) of the power conversion circuit is normally maintained at a relatively low frequency (F1), such as 60 kHz–150 kHz, corresponding to a relatively low output voltage (V-OP). However, when the CCFL 112 does not strike and thus does not draw current and illuminate, it is possible to increase the voltage across the CCFL 112 in order to cause the CCFL 112 to strike by increasing the operating frequency of the power conversion circuit.

The maximum output voltage (V-MAX) corresponding to the resonant frequency (F3) may not be necessary to provide a sufficient voltage (i.e., a striking voltage) to strike the CCFL 112. The striking voltage may be less than the maximum output voltage. Thus, in one embodiment of the power conversion circuit, the operating frequency is gradually increased from the run frequency (F1) to a striking frequency (F2) corresponding to the striking voltage (V-STRIKE) during an ignition process and maintained at the striking frequency to continuously apply the striking voltage to the CCFL 112 until the CCFL 112 ignites. The power conversion circuit uses voltage feedback to stop the operating frequency from sweeping once the striking voltage is reached for more efficient operation while providing reliable ignition of the CCFL 112.

Figure 4:
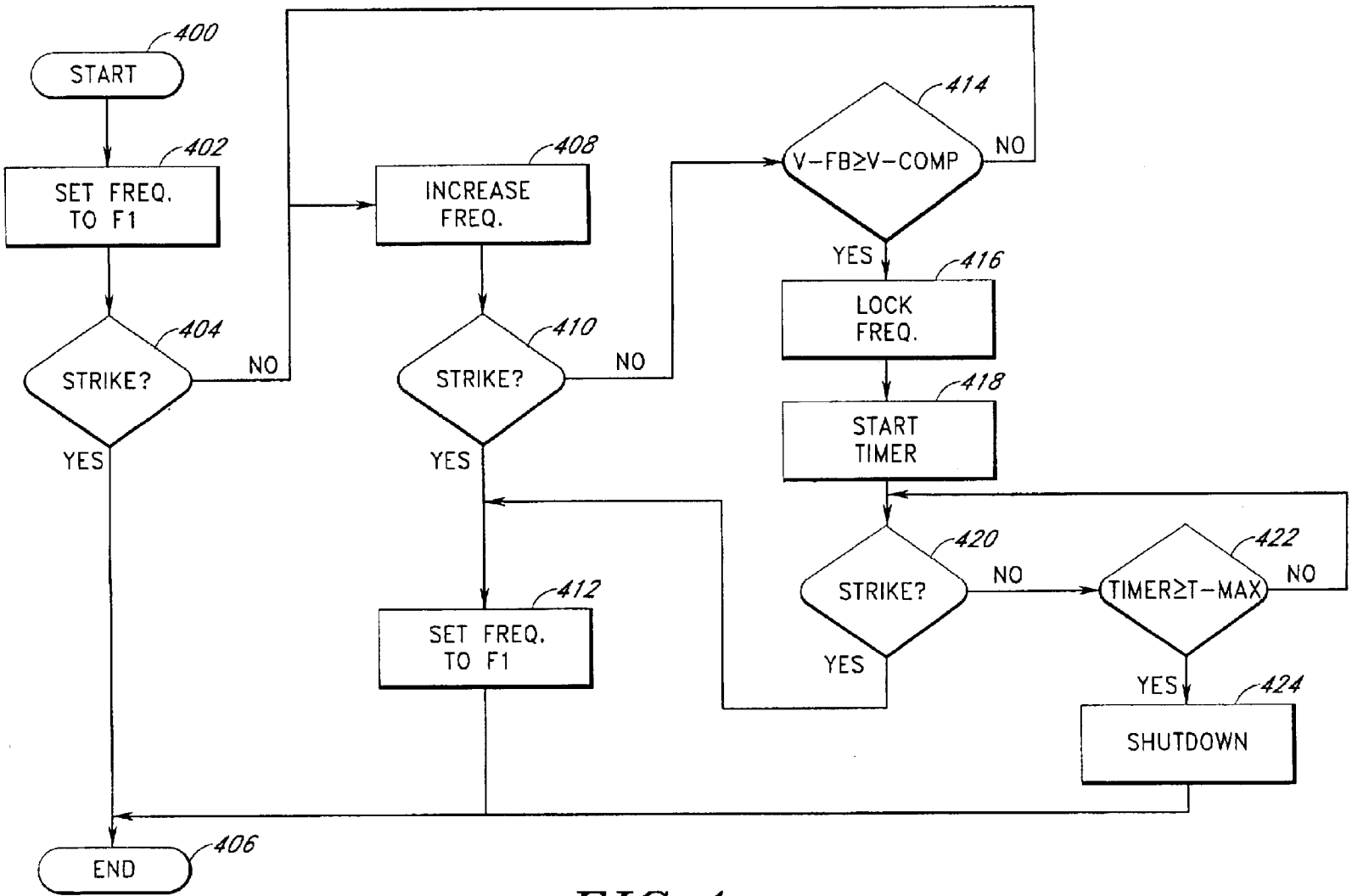
FIG. 4 is a flow chart of one embodiment of an ignition process for the power conversion circuit.

FIG. 4 is a flow chart of one embodiment of an ignition process for a power conversion circuit (or a lamp inverter). The lamp inverter advantageously provides the ignition process (or the lamp striking mode of operation) in which the output voltage is increased when a CCFL is not operating and no current is flowing. By increasing the output voltage, the CCFL can be caused to strike and draw current. When current through the CCFL is sensed, the voltage is then lowered to a normal operating voltage. The output voltage is caused to increase by increasing the operating frequency of the lamp inverter. After the CCFL has struck, the output voltage is returned to normal by lowering the operation frequency to the normal operating frequency.

The ignition process can be started at step 400 after power up, after a predetermined delay of the power up or when an enable signal is provided to the lamp inverter. The ignition process begins by setting the operating frequency of the lamp inverter to a normal run frequency (F1) at step 402.

At step 404, the ignition process determines if a CCFL coupled to the output of the lamp inverter is ignited. For example, a strike detect circuit can monitor lamp current pulses to determine if the CCFL is lighted. In one embodiment, the CCFL is considered lighted if a predetermined number of pulses (e.g., 8 or 16) above a predefined threshold is detected. If the strike detect circuit determines that the CCFL is lighted, the ignition process ends at step 406 and the lamp inverter begins normal operations.

If the strike detect circuit determines that the CCFL has not lighted at step 404, the ignition process begins sweeping the operating frequency while monitoring the status of the CCFL. For example, the ignition process increases the operating frequency at step 408 and checks for ignition of the CCFL at step 410. If step 410 determines that the CCFL is not ignited, the ignition process proceeds to step 414 to determine if a feedback voltage is greater than or equal to a comparison voltage indicating that a striking voltage at the output of the lamp inverter is reached. If the striking voltage has not been reached at step 414, the ignition process goes back to step 408. If step 410 determines that the CCFL is ignited, the ignition process continues to step 412 to reset the operating frequency of the lamp inverter to the normal run frequency, and the ignition process ends at step 406.

If step 414 determines that the striking voltage is reached, the ignition process proceeds to step 416 which locks the operating frequency to continuously provide the striking voltage at the output of the lamp inverter. A timer is started at step 418. Then the ignition process enters into an iterative process of checking for ignition of the CCFL at step 420 and checking for the timer to reach a predetermined duration at step 422. Any time step 420 determines that the CCFL is ignited, the ignition process continues to step 412.

Any time step 422 determines that the timer reaches or surpasses the predetermined duration, the ignition process proceeds to step 424 which shuts down the lamp inverter, and the ignition process ends at step 406. Shutting down the lamp inverter after the predetermined duration avoids overheating the transformer in the lamp inverter as a result of continuous high frequency operation. In one embodiment, the predetermined duration is chosen so that the strike voltage is supplied for a sufficient time to insure that a CCFL with worst case characteristics will strike at any temperature (e.g., approximately one to two seconds). If the CCFL fails to ignite after the predetermined duration, the lamp inverter automatically shuts down and may provide a status signal indicating that the CCFL is open or broken.

Figure 5:
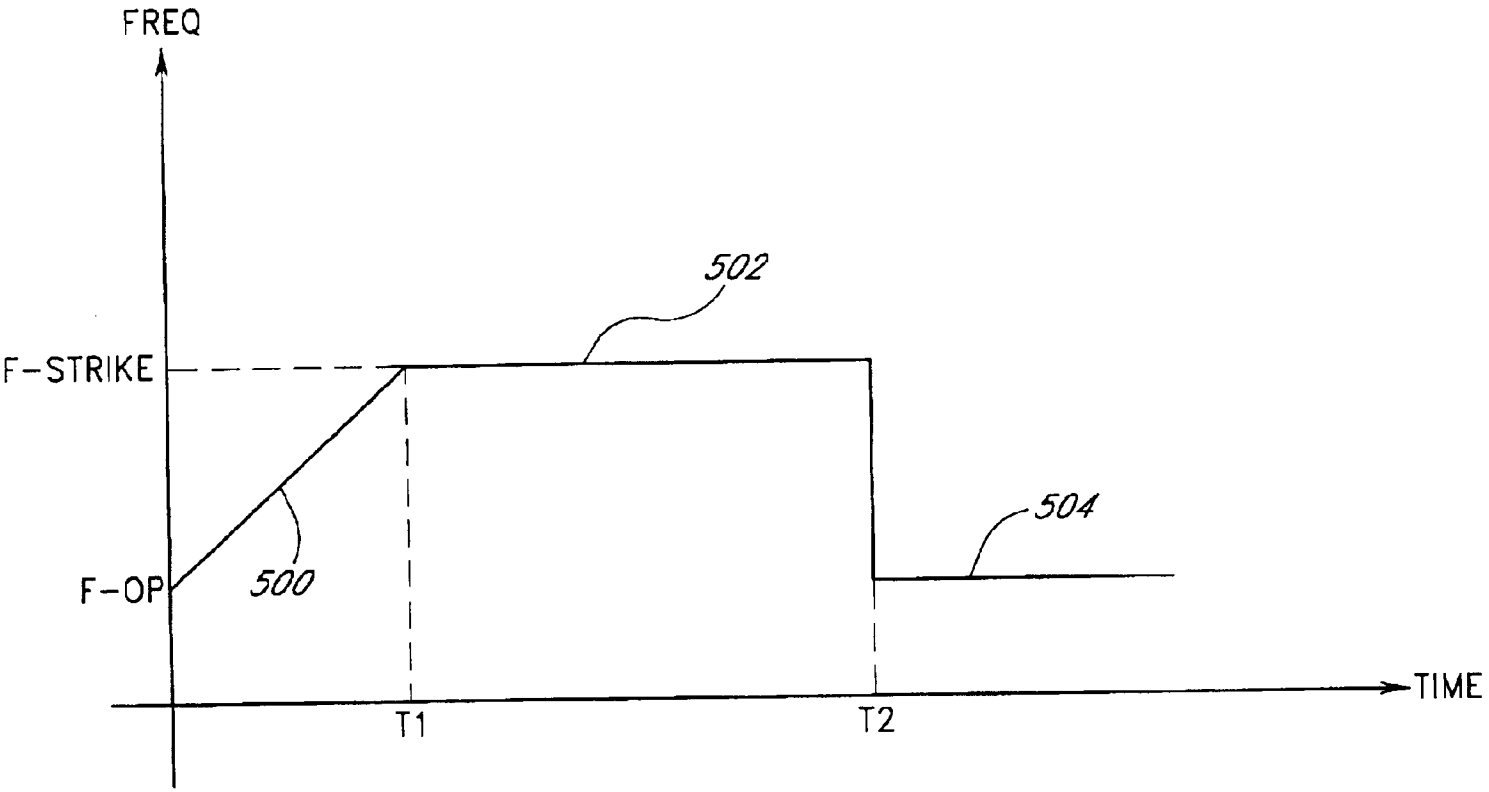
FIG. 5 illustrates a timing diagram that shows one possible frequency sequence during the ignition process.

FIG. 5 illustrates a timing diagram that shows one possible frequency sequence during the ignition process (or the lamp striking sequence) for a lamp inverter. A first segment 500 shows a linear frequency sweep from a normal operating frequency (F-OP) at time zero to a striking frequency (F-STRIKE) at time T1. A second segment 502 shows locking or holding the frequency at the striking frequency from time T1 to time T2. A third segment 504 shows reverting back to the normal operating frequency after time T2.

A strike detector may detect that a CCFL is not drawing current at time zero and enables a lamp striking sequence. The lamp striking sequence automatically ramps the operating frequency of the lamp inverter until time T1 when the increasing frequency results in a voltage (i.e., a striking voltage) sufficient o strike the CCFL. The lamp striking sequence stops ramping the operating frequency at T1 to continuously apply the striking voltage to the CCFL until time T2 when the CCFL strikes. A voltage feedback signal indicative of the output voltage level can be used to lock the operating frequency corresponding to the striking voltage. The striking voltage is provided at 100% duty cycle during the time interval between T1 and T2 (i.e., the strike interval) to result in quicker lamp striking. At time T2, the lamp striking sequence is automatically disabled so that the striking voltage is no longer applied to the CCFL.

Although described above in connection with CCFLs, it should be understood that a similar apparatus and method can be used to drive fluorescent lamps having filaments, neon lamps, and the like.

The presently disclosed embodiments are to be considered in all respect as illustrative and not restrictive. The scope of the invention being indicated by the append claims, rather than the foregoing description, and all changes which comes within the meaning and ranges of equivalency of the claims are therefore, intended to be embrace therein.

What is claimed is:

1. An apparatus for driving a fluorescent lamp, comprising:

an oscillator having a frequency control input and having an oscillator output at a frequency responsive to said frequency control input;

a transformer having a primary and a secondary, said secondary generating a voltage connectable to the fluorescent lamp;

at least first and second semiconductor switches responsive to said oscillator output which directly drive the primary of said transformer with a time-changing voltage waveform;

a sensor which senses whether current is flowing through the fluorescent lamp and which generates an output indicative of whether such current is flowing; and a frequency control circuit which receives said output of said sensor and which generates said frequency control input to said oscillator, said frequency control circuit maintaining said frequency control input substantially constant when current is flowing in the fluorescent lamp, said frequency control circuit varying said frequency control input when no current is sensed to sweep said frequency of the oscillator from a relatively low frequency to a strike frequency and hold said oscillator frequency at said strike frequency to cause the secondary output voltage of the transformer to produce a voltage sufficient to strike the fluorescent lamp and shifts to the operating frequency once the fluorescent lamp strikes wherein the operating frequency is lower than the strike frequency.

2. The apparatus of claim 1 further comprising said fluorescent lamp.

3. The apparatus of claim 1 wherein said fluorescent lamp is a cold cathode fluorescent lamp.

4. The apparatus of claim 3 wherein said cold cathode fluorescent lamp provides lighting for a flat panel display.

5. The apparatus of claim 4 wherein said flat panel display is in communication with a computer.

6. The apparatus of claim 3 wherein said cold cathode fluorescent lamp provides lighting for a scanner.

7. The apparatus of claim 6 wherein said scanner is in communication with a computer.

8. A method of starting a fluorescent lamp coupled to the secondary of a transformer, comprising:

sensing that no current is flowing through the lamp;

applying a series of pulses to a primary of the transformer at a pulse repetition frequency, the series of pulses causing the secondary of the transformer to have an output voltage, said pulse repetition frequency having an initial pulse repetition frequency; and while sensing for current through the lamp, sweeping the pulse repetition frequency of the series of pulses from said initial pulse repetition frequency to a striking pulse repetition frequency and holding at said striking pulse repetition frequency; and when current is sensed in the lamp, maintaining the pulse repetition frequency at a normal operating pulse repetition frequency wherein the normal operating pulse repetition frequency is lower than the striking pulse repetition frequency.

9. The method of claim 8, further comprising outputting a fault signal if the lamp fails to strike after a time period.

10. The method of claim 8, wherein said initial pulse repetition frequency is lower than said striking pulse repetition frequency.

11. The method of claim 8, wherein said initial pulse repetition frequency is higher than said striking pulse repetition frequency.

12. A method of starting a fluorescent lamp comprising:

applying a signal at a first frequency to a primary of a transformer to generate a first voltage at a secondary of said transformer;

sweeping a frequency of said signal to a strike frequency, said strike frequency generating a striking voltage at said secondary;

holding said strike frequency until at least striking a fluorescent lamp; and changing from said strike frequency to a normal operating frequency which is lower than said strike frequency in response to sensing a current in said fluorescent lamp.

13. The method of claim 12 further comprising signaling a fault condition if a current is not sensed in said fluorescent lamp after holding at said second frequency for a specified period of time.

14. The method of claim 12 wherein a voltage across said fluorescent lamp is monitored by using a capacitive voltage divider to produce a scaled voltage of the voltage levels across the fluorescent lamp.

15. The method of claim 12 wherein said second frequency is higher than said first frequency.

16. The method of claim 12 wherein said second frequency is lower than said first frequency.

17. The method of claim 12 further comprising lighting a flat panel display with said fluorescent lamp.

18. The method of claim 12 further comprising operating a scanner with said fluorescent lamp.

19. An apparatus for driving a fluorescent lamp, comprising:

a transformer having a primary and a secondary, said primary in communication with an input signal, said secondary configured to generate a voltage in response to a frequency of said input signal;

a sensor which is configured to generate an output indicative of whether current is flowing in a fluorescent lamp; and a control circuit in communication with said sensor, said control circuit configured to sweep the frequency of said input signal to a striking frequency and hold the frequency of said input signal at said striking frequency when said sensor does not indicate current is flowing, said control circuit further configured to decrease said frequency of said input signal when said sensor indicates that current is flowing.

20. The apparatus of claim 19 wherein said control circuit signals a fault after when said sensor does not sense sufficient current flowing in said fluorescent lamp after holding at said striking frequency for a specified period of time.

21. The apparatus of claim 19 wherein said control circuit is configured to maintain said frequency of said input signal substantially constant at a normal operating frequency when said sensor indicates current is flowing.

22. The apparatus of claim 19 further comprising at least first and second semiconductor switches to drive said primary of said transformer with a substantially rectangular wave voltage.

23. The apparatus of claim 22 further comprising a pulse width modulator having a frequency control input and having a pulse modulated output at a frequency responsive to said frequency control input and wherein said pulse modulated output drives said first and second semiconductor switches.

24. The apparatus of claim 23 wherein said control circuit generates said frequency control input to said pulse width modulator.

25. The apparatus of claim 19 further comprising said fluorescent lamp.

26. The apparatus of claim 25 wherein said fluorescent lamp is a cold cathode fluorescent lamp.

27. The apparatus of claim 25 wherein said fluorescent lamp provides lighting for a flat panel display.

28. The apparatus of claim 27 wherein said flat panel display is in communication with a computer.

29. The apparatus of claim 25 wherein said fluorescent lamp provides lighting for a scanner.

30. The apparatus of claim 29 wherein said scanner is in communication with a computer.

31. An apparatus for driving a fluorescent lamp, comprising:

a transformer means having a primary and a secondary, said primary in communication with an input signal, said secondary configured to generate a voltage in response to the frequency of said input signal;

a sensor means for generating an output indicative of whether current is flowing in a fluorescent lamp; and a control means in communication with said sensor means for sweeping the frequency of said input signal from an initial frequency to a striking frequency and holding at said striking frequency when said sensor means does not indicate current is flowing, and for decreasing said frequency of said input signal when said sensor means indicates that current is flowing.

32. The apparatus of claim 31 wherein said initial frequency is lower than said striking frequency.

33. The apparatus of claim 31 wherein said initial frequency is higher than said striking frequency.

34. The apparatus of claim 31 further comprising switching means for driving said primary of said transformer with a substantially rectangular voltage waveform.

35. The apparatus of claim 31 wherein said control means, after holding at said striking frequency for a predetermined time, signals a fault if said sensor means does not indicate that current is flowing.

36. The method of claim 31 wherein said striking frequency is a frequency sufficient to cause said fluorescent lamp to strike.

* * * * *